US006564959B2

(12) United States Patent
Saito et al.

(10) Patent No.: US 6,564,959 B2
(45) Date of Patent: May 20, 2003

(54) BOTTLE-TYPE PLASTIC CONTAINER WITH RECESSED GRIP HAVING AT LEAST TWO STEPS

(75) Inventors: Hiromichi Saito, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/058,309

(22) Filed: Jan. 30, 2002

(65) Prior Publication Data

US 2002/0162821 A1 Nov. 7, 2002

(30) Foreign Application Priority Data

Jan. 31, 2001 (JP) ..... 2001-023421

(51) Int. Cl.[7] ..... B65D 23/10
(52) U.S. Cl. ..... 215/384; 215/398; 220/771
(58) Field of Search ..... 215/379, 382, 215/384, 398; 220/771; D9/530, 540–553

(56) References Cited

U.S. PATENT DOCUMENTS

| | | | | |
|---|---|---|---|---|
| 3,225,950 A | * | 12/1965 | Josephsen et al. | 215/384 |
| 5,226,550 A | * | 7/1993 | Mikolaitis et al. | 215/384 |
| 5,472,105 A | * | 12/1995 | Krishnakumar et al. | 215/384 |
| 5,837,170 A | * | 11/1998 | Valyi | 215/6 X |
| 6,029,837 A | * | 2/2000 | Slat et al. | 215/384 |

FOREIGN PATENT DOCUMENTS

| | | |
|---|---|---|
| JP | Y2 4-33238 | 8/1992 |
| JP | Y2 4-33239 | 8/1992 |

* cited by examiner

*Primary Examiner*—Sue A. Weaver
(74) *Attorney, Agent, or Firm*—Oliff & Berridge, PLC

(57) ABSTRACT

A bottle-type plastic container includes a container body and an opening at one end of the container body for allowing liquid contents to be charged into the container and discharged therefrom. The container body has surface portions, which are recessed inwards and opposed to each other to define a grip region therebetween. The recessed surface portions are each defined by at least two shoulder-like steps that are engageable with consumer's fingers when the container is held by hand.

8 Claims, 4 Drawing Sheets

BOTTLE-TYPE PLASTIC CONTAINER WITH RECESSED GRIP HAVING AT LEAST TWO STEPS

BACKGROUND OF THE INVENTION

1. Field of Invention

The present invention relates a bottle-type plastic container having a container body that is partly recessed inwards to afford a grip region.

2. Description of Related Art

As a bottle-type container for beverages, alcoholic drinks, etc., a relatively large size plastic container is often used, having a capacity of 2,700 $cm^3$, for example, and produced by a biaxial orientation blow molding process or the like.

The body of such container is large and heavy in use, and is thus not always easy to stably hold by a single hand. Therefore, it has been a conventional practice to provide such a container with a separately prepared grip member that is fixedly secured to the body. However, provision of separate grip member is not very suitable solution from the viewpoint of reduction in production steps, cost and material. Furthermore, so-called separated collection of waste materials becomes difficult or time consuming particularly when the body and the grip member are comprised of mutually different materials and, hence, the grip member has to be removed from the body before disposition.

These problems can be effectively eliminated by a pinch grip-type container including a body that is partly recessed inwards to afford a grip region, as disclosed, for example, in JP-4-33,238Y2 or JP-4-33,239Y2. In this instance, the container body has surface portions that are recessed inwards and opposed to each other to define a grip region therebetween, which is configured so as to be engaged by consumer's hand. Such an arrangement proved to be highly advantageous in that a plastic container with an integral grip region can be produced efficiently and at low cost, without requiring a separate grip member to be prepared in advance and subsequently connected to the container body.

On the other hand, in order to perform a blow molding process to stably produce a pinch grip-type container with an intended shape, the container is generally designed to have as smooth and continuous an outer surface as possible. Such a design may make it difficult to realize sufficient and effective catch for the fingers, often resulting in that the container cannot be held stably and in a secure manner unless fingers are engaged with the recessed surface portions of the container body with a substantial pressure.

SUMMARY OF THE INVENTION

It is therefore an object of the present invention to provide an improved bottle-type plastic containers which eliminates the above-mentioned problems of the prior art, and which can be held stably and in a secure manner without requiring substantial pressure for engaging the fingers with the recessed surface portions of the container.

To this end, according to the present invention, a bottle-type plastic container includes a container body and an opening at one end of the container body for allowing liquid contents to be charged into the container and discharged therefrom. The container body has surface portions, which are recessed inwards and opposed to each other to define a grip region therebetween. The recessed surface portions are each defined by at least two shoulder-like steps that are engageable with consumer's fingers when the container is held by hand.

With the above-mentioned arrangement of the bottle-type plastic container according to the present invention, the recessed surface portions of the container body are each defined by at least two shoulder-like steps each forming a catch that can be readily and positively engaged by consumer's fingers when the container is held by hand. The plastic container having such a design can be stably and efficiently produced by blow molding process, without causing defective shape even when the edge of the recessed surface portion defined by the shoulder-like step has a sharp curvature or a small radius of curvature.

Advantageously, the recessed surface portions of the container body are each provided with a reinforcement rib that extends in circumferential direction of the container body, for dividing the recessed surface portion into upper and lower parts.

In this instance, it is preferred that the reinforcement rib is arranged substantially at a midpoint of the recessed surface portion as seen in a longitudinal direction of the container body.

It is also preferred that the reinforcement rib has a wall that forms an angle relative to a bottom wall of the recessed surface portion, said angle being substantially 90°.

Advantageously, a plurality of ribs are formed on the bottom wall of the recessed surface portion and/or at a grip region adjacent to the recessed surface portion, said ribs being arranged to extend in the circumferential direction of the container body to provide an improved engagement with consumer's hand.

The container according to the present invention may have an inner volume within a range of 1,800–4,000 $cm^3$.

BRIEF DESCRIPTION OF THE DRAWINGS

The present invention will be explained below in further detail, with reference to a preferred embodiment shown in the drawings.

DETAILED DESCRIPTION OF THE PREFERRED EMBODIMENT

Figure 1:
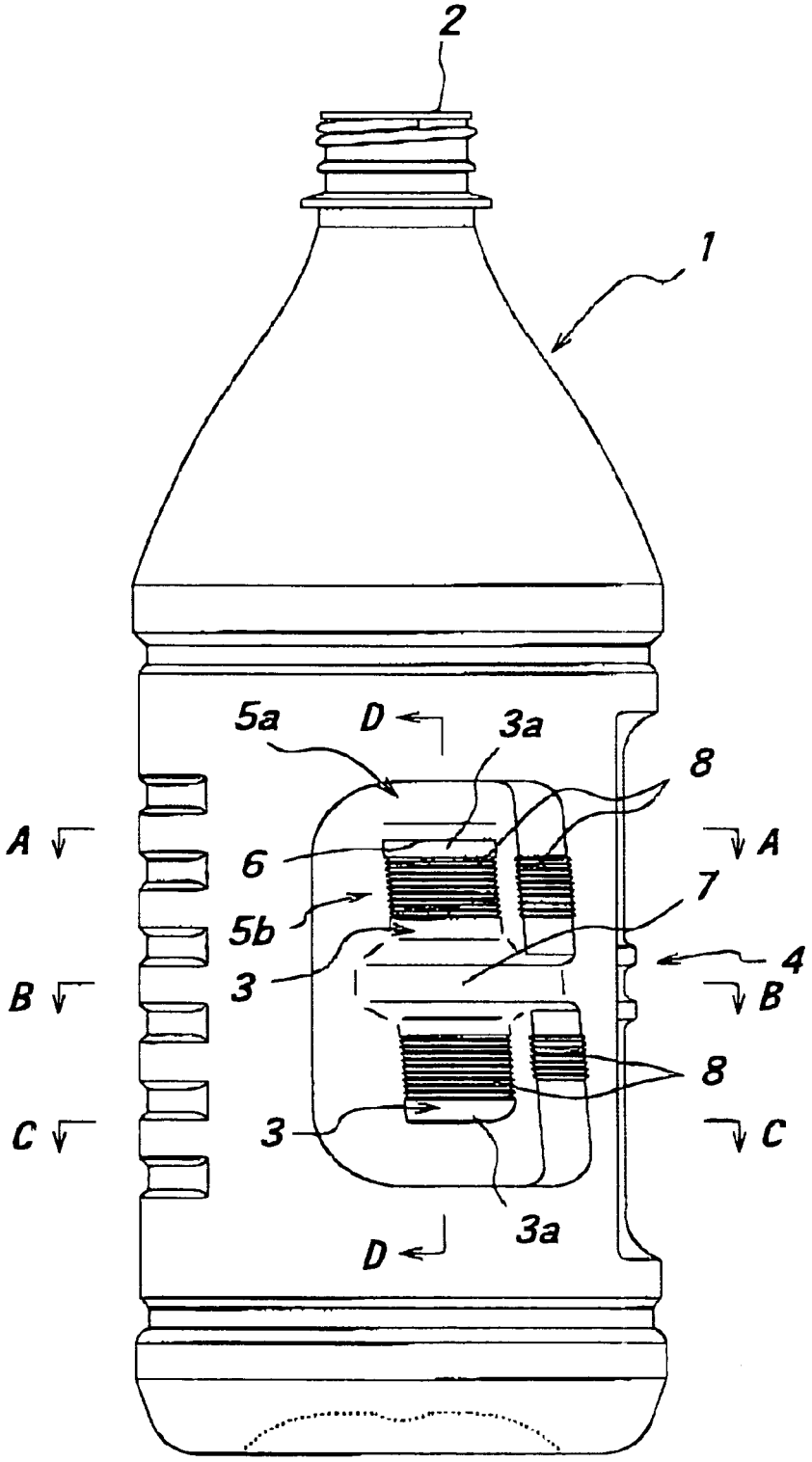
FIGS. 1 and 2 are side view and rear view, respectively, of the bottle-type plastic container according to one embodiment of the present invention.
Figure 2:
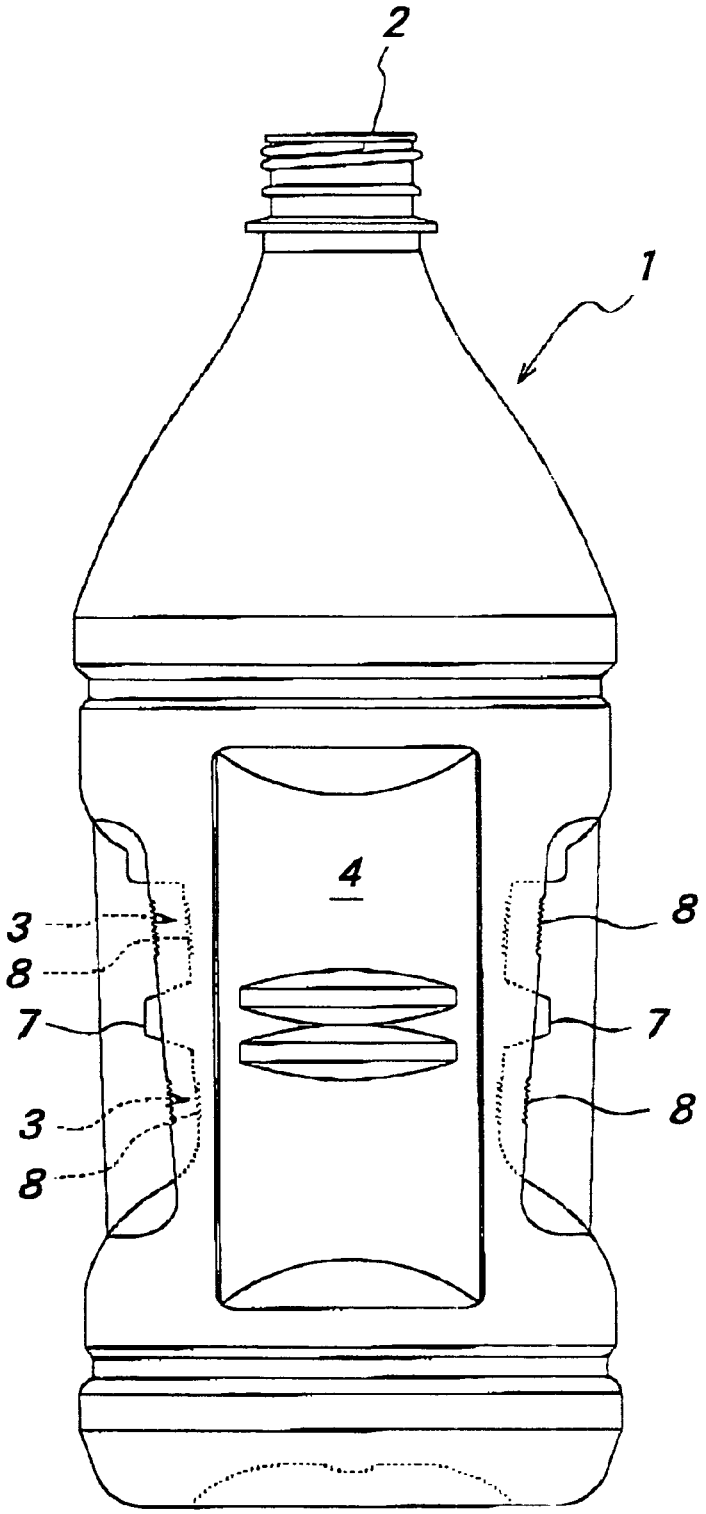
Figure 3A:
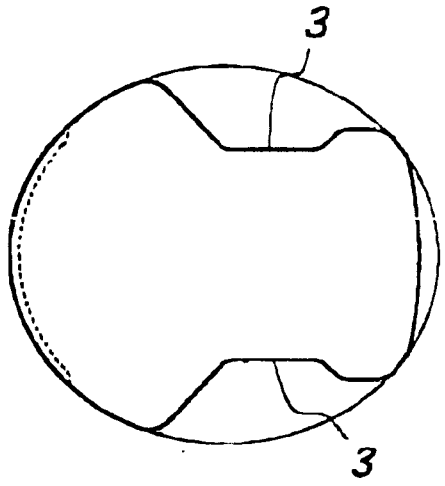
FIGS. 3*a*, 3*b* and 3*c* are schematic cross-sectional views taken along the lines A—A, B—B and C—C in FIG. 1, respectively.
Figure 3B:
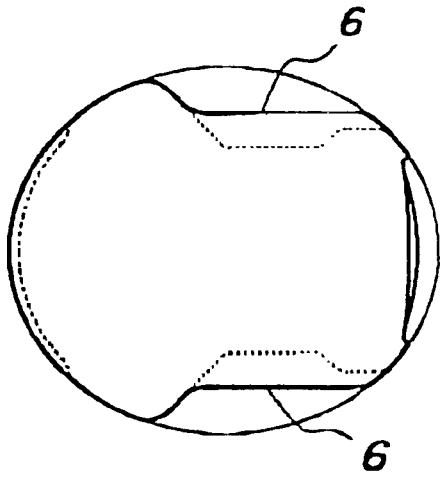
Figure 3C:
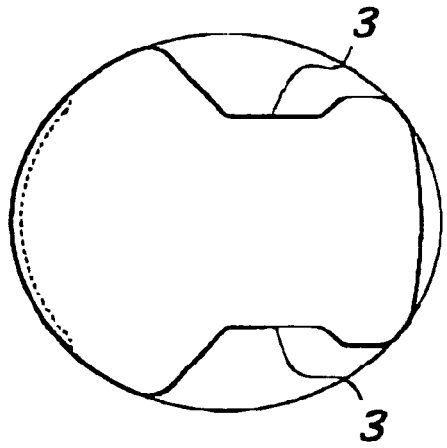

Referring now to FIGS. 1 and 2, there is shown a bottle-type plastic container according to one embodiment of the present invention. The container includes a substantially cylindrical container body designated as a whole by reference numeral 1. An opening 2 is formed at an upper end region of the container body 1, for allowing the container to be filled with liquid contents and emptied therefrom. For the sake of convenience, it is assumed that the container has an inner volume of 2,700 $cm^3$.

The container according to the present invention may be made of an appropriate synthetic resin, typically a saturated polyester-type thermoplastic resin having a sufficient resistance to chemicals, such as polyethylene terephthalate (PET) resin, polybuthylene terephthalate resin or polyethylene naphthalate resin. The container may be formed by known molding processes, such as biaxial orientation blow molding process or direct blow molding process. The container may be made of a single layer of the above-mentioned resin, or three or five layers comprised of outer and inner layers of the above-mentioned resin with one or more barrier layers therebetween. In this instance, the barrier layers may be comprised of polyimide resin or ethylene vinyl alcohol copolymer (EVOH) resin. When the container is made of a single layer, it may be comprised of a blend of the above-mentioned polyester resin and the barrier resin.

The container body 1 includes front and rear surface portions, of which the front surface portion serves as an ornamental portion either in the form of a printed surface, or bearing a heat shrink label or the like, indicating visual information such as trademark or the like. On the other hand, as shown in FIG. 1 and FIGS. 3*a* to 3*c*, both sides of the rear surface portion of the container body 1 are recessed inwards to provide depressions 3 on opposite sides, for defining a grip region 4 therebetween. As can be appreciated from FIG. 2, the grip region 4 in the rear surface portion is in the form of a panel that allows a limited deformation of the grip region 4 when being grasped by hand, or when the liquid content within the container is subjected to change in temperature.

Figure 4:
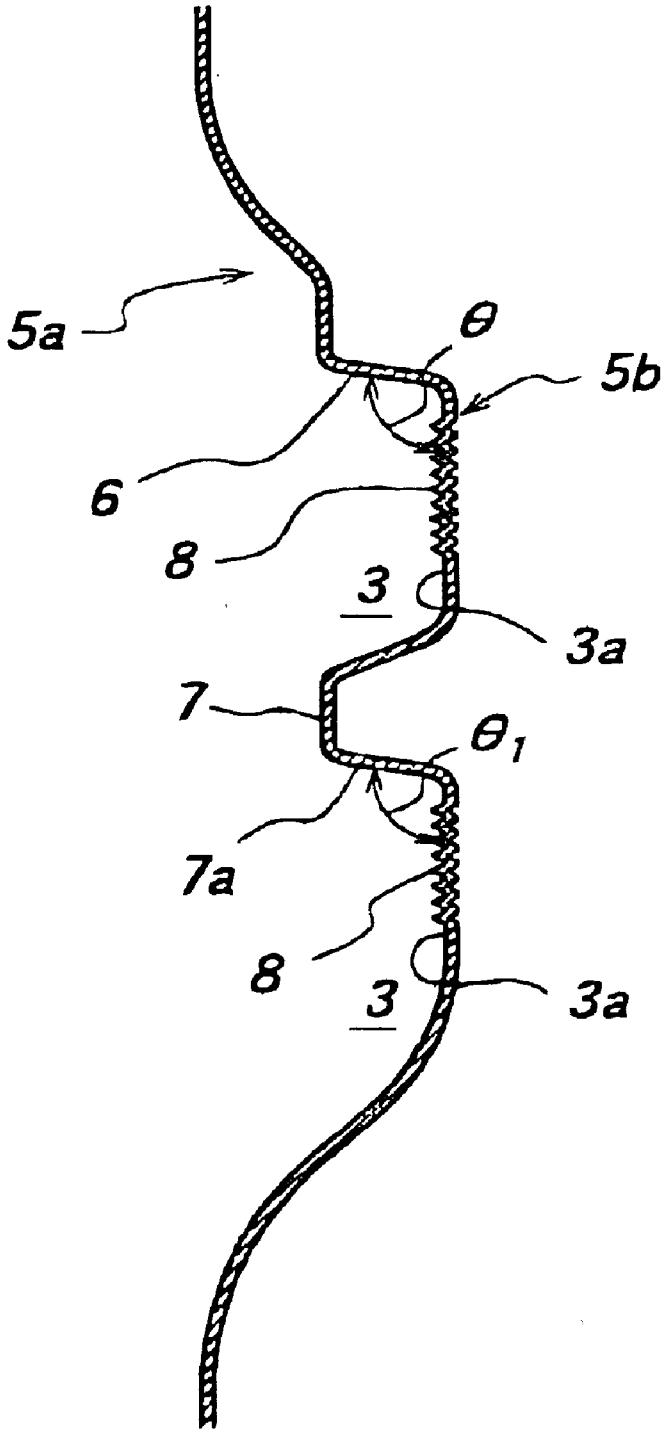
FIG. 4 is a schematic sectional view taken along the line D—D in FIG. 1.

As clearly shown in FIGS. 1 and 4, the upper part of the depression 3 is formed by two shoulder-like steps 5*a*, 5*b*, of which the step 5*b* on the lower side forms a catch 6 that can be engaged by consumer's fingers. A reinforcement rib 7 is integrally provided substantially at the center of the depression 3 so as to extend in the circumferential direction of the container body 1, thereby dividing the depression into upper and lower parts. These reinforcing ribs 7 preserve the required rigidity and strength of the container body 1. The front surface portion of the container body 1 may also be formed with reinforcements in the form of ribs or grooves, whenever necessary to provide further enhanced rigidity or strength of the container body 1.

A plurality of ribs 8 are formed on the bottom wall 3*a* of the depression 3 and also at the grip region 4 adjacent to the depression 3. These ribs 8 are arranged to extend in the circumferential direction of the container body 1 to provide an improved engagement with consumer's hand without causing slips.

In the production of pinch grip-type plastic containers by blow molding of a preform made of thermoplastic resin such as polyethylene terephthalate resin under predetermined process conditions, particularly when depressions with a small radius of curvature is formed in the outer surface of the container body, it becomes difficult to stably form the container with the intended design shape due to fluctuation in stretching of the resin and/or local variation in thickness of the resin. For these reasons, it has been a conventional practice to design the container to have as smooth and continuous an outer surface as possible. Such a design often made it difficult, as mentioned above, to realize sufficient and effective catch for the fingers, often resulting in that the container cannot be held stably and in a secure manner unless fingers are engaged with the recessed surface portions of the container body with a substantial pressure.

According to the present invention, the depressions 3 of the container body 1 are each defined by at least two shoulder-like steps 5*a*, 5*b* forming a catch 6 that can be effectively engaged by consumer's fingers when the container is held by hand. In this connection, the catch 6 may be designed to form an angle θ relative to the bottom of the depression 3, wherein the angle θ may be as large as 90°. Such a design ensures that the catch 6 can be readily and positively engaged by consumer's fingers. Despite a large angle θ and thus, a relatively small radius of curvature at the edge of the depression 3, the plastic container according to the present invention can be stably and efficiently produced by blow molding process, without causing defective shape.

As mentioned above, the reinforcement rib 7 at the center of the depression 3 preserves the required rigidity and strength of the container body 1. The reinforcement rib 7 has a wall 7*a* that forms an angle θ relative to the bottom of the depression 3, wherein the angle $\theta_1$ may be as large as 90°. In this instance, the reinforcement rib 7 can also be used as an additional catch for consumer's fingers. Thus, depending upon remaining amount of the contents in the container and, hence, change in weight or center of gravity of the container, the consumer's fingers may be selectively engaged with either one of the catches 6, 7 in such manner as to facilitate discharging of the content.

It will be appreciated from the foregoing description that the present invention provides an improved bottle-type plastic container, which can be held stably and in a secure manner without requiring substantial pressure for engaging the fingers with the recessed surface portions of the container.

While the present invention has been described above with reference to a specific embodiment, various changes and/or modifications may be made without departing from the scope of the invention as defined by the appended claims.

What is claimed is:

1. A bottle-type plastic container comprising a container body and an opening at one end of the container body, for allowing liquid contents to be charged into the container and discharged therefrom, said container body having surface portions which are recessed inwards and opposed to each other to define a grip region therebetween, wherein the recessed surface portions are each defined by at least two shoulder-like steps having walls that form an angle relative to a bottom wall of the recessed surface portion of substantially 90° to provide catches that are engageable with consumer's fingers when the container is held by hand to allow stable holding of the container without requiring substantial pressure by the consumer's fingers.

2. The bottle-type plastic container according to claim 1, wherein said recessed surface portions of the container body are each provided with a reinforcement rib that extends in circumferential direction of the container body, for dividing the recessed surface portion into upper and lower parts.

3. The bottle-type plastic container according to claim 2, wherein said reinforcement rib has a wall that forms an angle relative to a bottom wall of the recessed surface portion, said angle being substantially 90°.

4. The bottle-type plastic container according to claim 2, wherein said reinforcement rib is arranged substantially at a midpoint of the recessed surface portion as seen in a longitudinal direction of the container body.

5. The bottle-type plastic container according to claim 4, wherein said reinforcement rib has a wall that forms an angle relative to a bottom wall of the recessed surface portion, said angle being substantially 90°.

6. The bottle-type plastic container according to claim 1, wherein a plurality of ribs are formed on a bottom wall of the recessed surface portion, said ribs being arranged to extend in the circumferential direction of the container body to provide an improved engagement with consumer's hand.

7. The bottle-type plastic container according to claim 6, further comprising a plurality of circumferentially extending ribs provided on a grip region immediately adjacent the recessed surface portions.

8. The bottle-type plastic container according to claim 1, wherein said container has an inner volume within a range of 1,800–4,000 $cm^3$.

* * * * *